United States Patent [19]

Gilbert

[11] 4,430,095

[45] Feb. 7, 1984

[54] GASEOUS MIXTURE FROM LIQUID FUEL AND AIR

[76] Inventor: Jack J. Gilbert, 3 River Rd., Suffern, N.Y. 10901

[21] Appl. No.: 368,102

[22] Filed: Apr. 14, 1982

[51] Int. Cl.[3] ..... F02M 9/12

[52] U.S. Cl. ..... 48/180 C; 48/180 M; 48/180 S; 48/211; 123/3; 261/51; 261/90

[58] Field of Search ..... 48/180 C, 180 M, 180 P, 48/180 S, 211, 212, 102 R, 107; 123/3; 261/51, 88, 89, 90

[56] References Cited

U.S. PATENT DOCUMENTS

| | | | |
|---|---|---|---|
| 2,351,072 | 6/1944 | Schmidt | 48/180 |
| 3,414,243 | 12/1968 | Baczkowski et al. | 261/51 |
| 3,701,513 | 10/1972 | Carter | 261/88 |
| 3,711,257 | 1/1973 | Linn | 48/180 R |
| 3,871,838 | 3/1975 | Henkel et al. | 48/180 C |
| 3,946,717 | 3/1976 | England | 48/180 S |
| 3,962,411 | 6/1976 | Setzer et al. | 48/211 X |
| 4,053,013 | 10/1977 | Guba | 165/86 |
| 4,149,853 | 4/1979 | DesMarais et al. | 44/50 |
| 4,150,954 | 4/1979 | Abthoff et al. | 48/102 A |
| 4,264,539 | 4/1981 | Berg | 261/142 |
| 4,311,128 | 1/1982 | Bernecker | 123/557 |
| 4,373,502 | 2/1983 | Re | 261/51 |

OTHER PUBLICATIONS

D. J. Bak: "Liquid Petroleum Gasifier Replaces Carburetor," Design News, Mar. 9, 1981, Cahners Publishing Co.

*Primary Examiner*—Arthur D. Kellogg
*Attorney, Agent, or Firm*—Kenyon & Kenyon

[57] ABSTRACT

Liquid fuel, such as gasoline, is converted into gaseous form in an enclosed chamber rotating at high speed (e.g., 10,000 rpm) and containing a catalyst support material impregnated with 90% cupric chloride and 10% nickel chloride by weight. The converted fuel passes through a microporous (e.g., 40 microns) peripheral wall of the container and then mixes uniformly with air flowing through an annular space surrounding the container to form a combustible mixture.

21 Claims, 4 Drawing Figures

GASEOUS MIXTURE FROM LIQUID FUEL AND AIR

BACKGROUND OF THE INVENTION

1. Technical Field

The present invention relates to the conversion of liquid fuel to gaseous form and particularly to a method and apparatus for producing a flow of combustible gaseous mixture of fuel and air for use in a combustion apparatus, particularly in an internal combustion engine.

2. Background Art

Recent efforts to reduce fuel consumption and pollution of internal combustion engines have been directed increasingly to the problems of nonuniform mixing of fuel and air and of fuel condensation in the intake passages. In conventional venturi carburetors, liquid fuel is delivered in a finely-divided spray, part of which tends to condense upon cold intake passage walls. To assure that a combustible mixture will reach the cylinders, the carburetor must be adjusted to give a rich mixture during engine warm up. In addition, the delivery of fuel in the form of directional droplets makes it difficult to achieve completely uniform mixing with the intake air flowing through the carburetor.

Attempts to solve this problem have focused on methods and apparatus for heating the fuel/air mixture and/or heating intake passage surfaces, either electrically or by exhaust gases, to promote vaporization of the fuel. The mixture heating may be accomplished in conjunction with rotational mixing, as in U.S. Pat. No. 4,053,013 of P. Guba, U.S. Pat. No. 4,264,539 of R. E. Borg, and U.S. Pat. No. 4,311,128 of G. Bernecker.

Bernecker also teaches passing a spray of liquid fuel mixed with air through a porous medium to improve atomization, as does L. L. Wallace in U.S. Pat. No. 3,711,257. U.S. Pat. No. 4,150,954 of J. Abthoff et al. discloses the use of a catalyst on a porous support for splitting a mixture of air and diesel fuel into combustible gaseous components, such as $H_2$, CO, and $CH_4$, and also containing $CO_2$ and $H_2O$. The catalytic reaction requires a relatively high temperature, induced initially by glow plugs and maintained either by premixing pure air with the fuel to create an exothermic reaction or by premixing hot exhaust gases with the fuel to create an endothermic reaction.

An obvious drawback to heat augmented fuel vaporization or splitting is the increased risk of fire, particularly when the fuel is mixed with air to form a combustible mixture prior to or concurrently with the heating. In addition, when the combustion air is combined with the liquid fuel before passing the mixture through a porous medium to fully evaporate the fuel, a very large flow cross section is required to avoid unacceptably high pressure drop through the porous medium.

SUMMARY OF THE INVENTION

It is an object of the present invention to provide a method and apparatus for converting a flow of liquid fuel into essentially gaseous form and for uniformly mixing the gaseous fuel with a flow of air for efficient burning in a combustion apparatus.

A further object of the invention is to provide a method and apparatus for low temperature catalytic conversion of liquid fuel into essentially gaseous form and centrifugal dispersion of the gaseous fuel into a flow of air directed to an internal combustion engine.

Another object of the invention is to provide apparatus for simultaneously controlling flows of fuel and air to maintain a predetermined fuel/air ratio without the use of a venturi.

These and other objects are achieved by a method for providing a gaseous mixture of fuel and air to a combustion apparatus, wherein the method comprises:

delivering a flow of air to a combustion apparatus via an intake passage;

delivering a flow of liquid fuel to a fuel chamber located inside the intake passage; and rotating the fuel chamber to urge the fuel by centrifugal force through a peripheral microporous wall of the chamber concentric with the axis of rotation.

A device for performing the method of the invention comprises:

a housing having an air intake passage with an inlet end communicating with the atmosphere and an outlet end connected to a combustion apparatus;

an enclosed fuel chamber positioned centrally within the intake passage, said fuel chamber having an axis of symmetry and a microporous peripheral wall encircling said axis;

means for supporting the fuel chamber for rotation about its axis of symmetry within the intake passage;

a conduit for delivering liquid fuel to the fuel chamber via said supporting means; and means for rotating the fuel chamber about said axis to force the fuel centrifugally through said porous wall, whereby the fuel emerges from the porous wall in substantially gaseous form and with a velocity component tangential to said porous wall to assure thorough mixing with air flowing through the intake passage around the fuel chamber.

An effective rotational speed is about 10,000 rpm. Desirably the fuel chamber contains a carrier material impregnated with a catalyst. The preferred catalyst consists of 85% to 95% by weight of cupric chloride, and 15% to 25% by weight of nickel chloride. The carrier may be activated charcoal, alumina, or silica gel.

The device of the invention is particularly adapted to provide an efficient-burning combustible mixture of an internal combustion engine in place of a conventional carburetor, and preferably additionally comprises:

a fuel metering valve in the fuel conduit for controlling the flow of liquid fuel therethrough;

a throttle valve positioned in the intake passageway for controlling the flow of gas therethrough; and means coupling the fuel metering valve and the throttle valve for operating said valves together to provide a predetermined relation between fuel flow and gas flow.

BRIEF DESCRIPTION OF THE DRAWINGS

The invention will be more clearly understood by reference to the accompanying drawings and the associated detailed description.

DETAILED DESCRIPTION OF THE PREFERRED EMBODIMENTS

Figure 1:
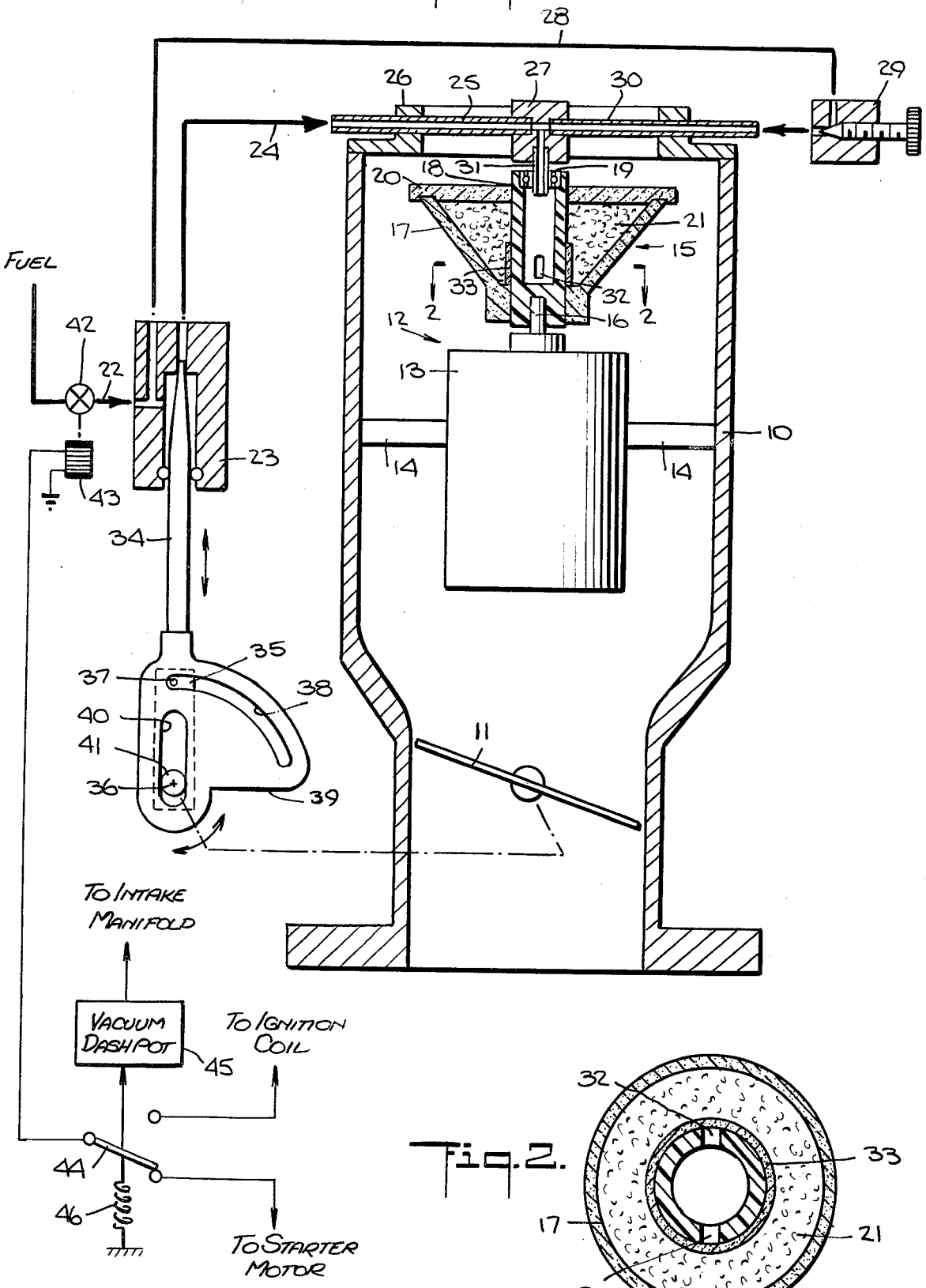
FIG. 1 shows a semi-schematic elevation view, in cross section, of a device according to the invention.
Figure 2:
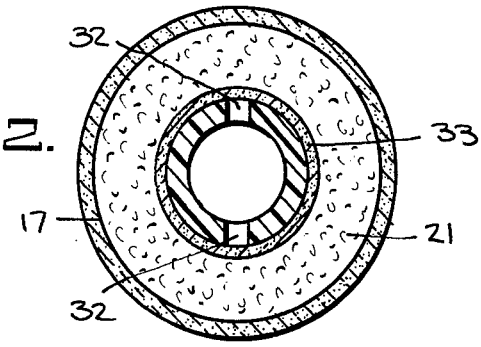
FIG. 2 is a plan view in cross section of the fuel chamber of FIG. 1 taken in the direction of arrows 2—2.

With reference to FIGS. 1 and 2, one embodiment of a device according to the invention has an intake housing 10 which is adapted for mounting on an intake manifold of an internal combustion engine (not shown) in place of a conventional carburetor. The housing contains a throttle valve 11 positioned below a gasifier apparatus 12. The gasifier apparatus includes an electric motor 13 centrally positioned by struts 14 in the housing and an enclosed fuel chamber 15 fixed to the motor shaft 16.

The enclosed fuel chamber includes a frusto-conical cup 17 made of a material such as polyethylene which is unaffected by gasoline. Cup 17 has a central coaxial tube 18 which is fitted with a ball bearing 19 at its upper end. Tube 18 may be formed integrally with cup 17, or it may be cemented or otherwise fastened to the cup. A cover 20 made of a porous material, such as sintered ceramic, having a pore size preferably of about 40 microns closes the cup.

Preferably, the cup is filled with particulate material 21 such as silica gel, alumina, or activated charcoal. This material may serve as a carrier for a catalyst, a preferred catalyst being composed of approximately 85% to 95% by weight of cupric chloride and approximately 25% to 35% by weight of nickel chloride. The carrier material can be impregnated by immersing the carrier in an aqueous solution of cupric chloride and nickel chloride in the desired weight ratio for about 10 minutes. The impregnated carrier is then dried in an oven at about 100° C. for approximately 25 to 30 minutes.

Liquid fuel (e.g., gasoline) is delivered through a line 22 at approximately 3 psi from a conventional fuel pump (not shown) to a metering valve 23. From the metering valve the fuel flows through a line 24 to a radial inlet pipe 25 inserted through a mounting ring 26 attached to the top of the housing 10 and having its inner end fitted into a distribution block 27. When the metering valve 23 is shut, fuel can go through a bypass line 28 and a manually adjustable idling valve 29 to a second radial inlet pipe 30, which also terminates in the distribution block 27. From either path, the fuel flows downward from the distribution block through a tube 31 inserted through a bore of bearing 19 into the tube 18. The incoming fuel then flows through at least one outlet 32 at the bottom of tube 31 and a porous sleeve 33 into the fuel chamber. Sleeve 33 prevents entry of catalytic carrier granules into the tube 31 while allowing free passage of fuel into the chamber.

Electric motor 13 is connected to the ignition switch of the engine via a lead (not shown) passed through one of the support struts 14. When the ignition switch is turned on, motor 13 is actuated. It is desirable that the motor rotate at high speed to obtain substantial centrifugal effect and also a high tangential velocity at the periphery of the porous cover 20 of the fuel chamber. In an operational embodiment of the device, a motor speed of approximately 10,000 rpm has been used with excellent results. As the motor and the fuel chamber rotate at this high speed, the liquid fuel moves upward and outward, percolating through the granular, catalyst-impregnated material, until it reaches the porous cover 20. The fuel passes through the porous wall of the cover, emerging in essentially gaseous form primarily from the peripheral edge of the cover due to the high centrifugal forces generated by the high speed rotation of the fuel chamber, and immediately mixes thoroughly and uniformly with air flowing into the top of the housing and through the annular space around the chamber. The resulting dry gaseous combustible mixture then continues downward, through the throttle valve 11 for delivery to the engine.

The ratio of fuel to air is controlled by linking the movement of a needle 34 of metering valve 23 to the rotation of the throttle valve 11 by means of an arm 35 pivoted about an axis 36 and carrying a pin 37 which moves in an arcuate slot 38 of a cam plate 39 attached to the needle 34. The cam plate has also a straight elongated slot 40 extending coaxially with the shaft of the needle 34 and loosely engaging a shaft 41 to which the arm 35 is fastened. Shaft 41 preferably is an extension of diametral shaft 42 of the butterfly throttle valve 11, but it can be a separate shaft coupled to the throttle valve by any conventional linkage if it is not convenient to mount the needle valve actuating mechanism directly on the throttle valve shaft.

Rotary movement of arm 35 is converted into axial movement of needle 34 by making the radius of curvature of arcuate slot 38 greater than the distance from axis 36 to pin 37. The degree of needle valve opening relative to throttle valve opening is a function of the difference between the radius of curvature of slot 38 and the distance of pin 37 from axis 36, as well as the diameter of the valve seat and the taper of the needle. By appropriate adjustment of these factors a proper fuel to air ratio can be maintained through the full range of throttle angles to assure efficient combustion with minimum exhaust pollutants for all operating conditions of the engine.

If the engine is equipped with an electric fuel pump, the pump will operate whenever the ignition switch is turned on. This can cause flooding if the engine stalls, unless the ignition switch is immediately turned off. To avoid this problem, in vehicles equipped with electric fuel pumps the device of the invention includes means for positively shutting off fuel flow unless the engine is turning. As shown in FIG. 1, such means may include a shutoff valve 42 installed in the fuel line ahead of metering valve 23. Valve 42 is actuated by a solenoid coil 43 which is connected through a switch 44 selectively either to the starter motor or to the primary winding of the ignition coil. Switch 44 is operationally coupled to a vacuum dashpot 45 (e.g., a diaphragm actuator) connected to the intake manifold of the engine. The dashpot is biased by a spring 46 to connect switch 44 to the starter motor unless the vacuum in the intake manifold exceeds a value sufficient to move the switch to the ignition coil position. It is thus clear that the fuel shutoff valve will be actuated to open when the engine is being cranked and when it is running, but is will be shut at all other times, whether or not the ignition switch is on.

Figure 3:
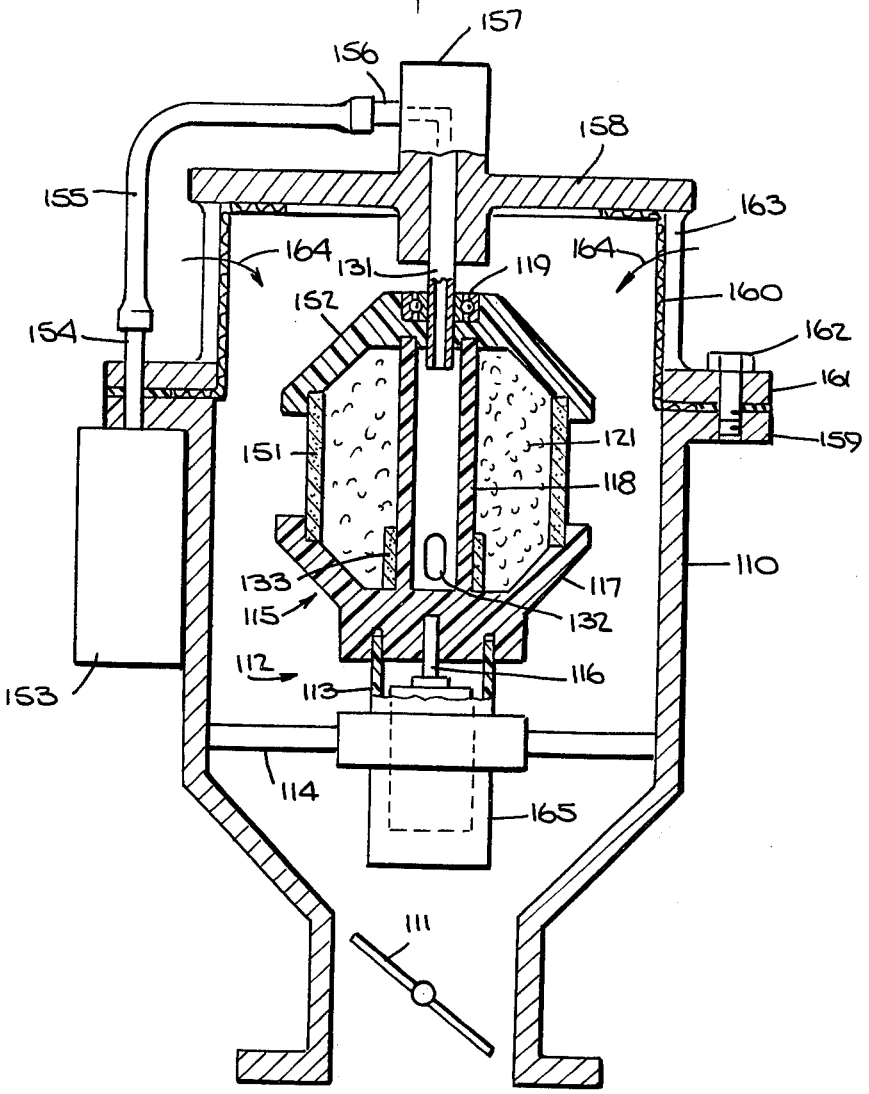
FIG. 3 shows a semi-schematic elevation view, in cross section, of an alternative embodiment of a device according to the invention.

An alternative embodiment of a device for supplying a variable flow of a gaseous mixture of fuel and air to a combustion apparatus, such as an internal combustion engine, is shown in FIG. 3. In this figure, components similar to those of the embodiment of FIGS. 1 and 2 are identified by the same number, but prefixed by the numeral 1, and will not be further described except in connection with the features which are different in this embodiment. Thus, the device of FIG. 3 also has an intake housing 110 adapted to be mounted in place of a conventional carburetor on an internal combustion engine, with a rotary gasifier apparatus 112 centrally positioned within the housing.

In the gasifier apparatus of FIG. 3, the porous cover of the embodiment of FIG. 1 is replaced by a porous cylindrical shell 151 which is held between a lower cup shaped end cap 117 and an upper inverted cup-like end cap 152. This arrangement provides a greater area of porous wall for diffusion of the fuel and also a smoother flow of air around the rotary fuel chamber 115.

The device of FIG. 3 also differs from that of FIG. 1 in that fuel is delivered from a metering valve (not shown) to a distribution block 153, from when it flows through an outlet pipe 154, a flexible tube 155, and an inlet pipe 156 to a central boss 157 of a cover plate 158 supported coaxially above an upper flange 159 of the intake housing by a cylindrical screen 160. The top of the screen is fastened to the cover 158, and the bottom of the screen is fastened to a flange 161, which is secured to flange 159 by bolts 162. Spaced vertical legs 163 may also be used to support cover 158 above flange 161, but if the screen is sufficiently stiff, these legs are not necessary.

The above arrangement facilitates clamping a conventional air cleaner (not shown) to the periphery of flanges 159, 161, with air flowing radially inward from the cleaner through screen 160 and then curving downward to flow through the annular space around the fuel gasifier unit, as shown by arrows 164.

The gasifier unit of FIG. 3 also includes a casing 165 for electric motor 113, the upper end of the casing extending into an annular groove 166 in the bottom of end cap 117 to form a simple rotary labyrinth seal for assuring that the combustible mixture flowing through the intake housing is not exposed to a possible spark from the motor.

In all respects other than the above-described differences, the embodiment of FIG. 3 functions in the same way as that of FIG. 1. Particularly, fuel entering the chamber through the bottom openings 132 of center tube 118 diffuses through the catalyst-impregnated material 121 and then flows outwardly through porous wall 151 in essentially gaseous form. The high rotational speed of the fuel chamber causes the exiting flow of gaseous fuel to mix vigorously with the downward flowing air by means of a strong circular shear mechanism, so that a highly uniform mixture of gaseous fuel and air is delivered through the throttle valve.

Figure 4:
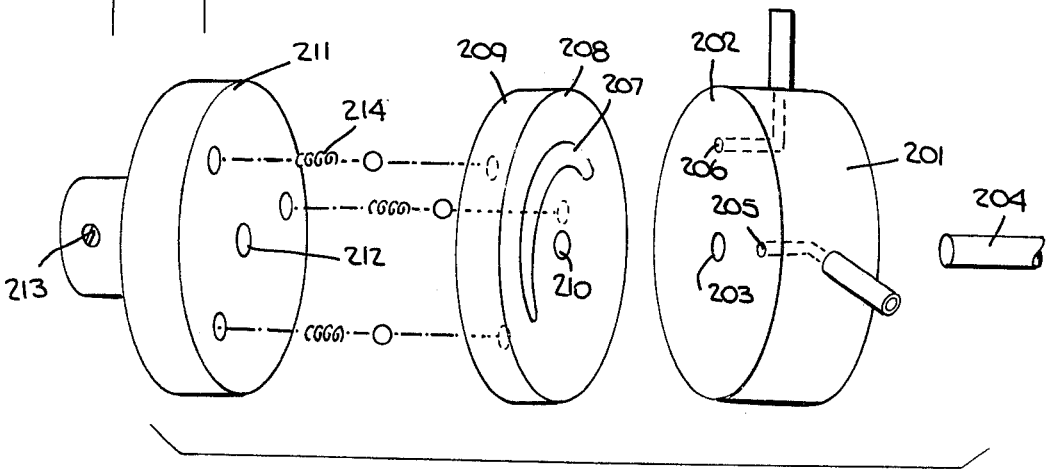
FIG. 4 is an exploded view in perspective of an alternative embodiment of a fuel control valve for use with a device as in FIG. 1 or 3.

The fuel metering valve for the embodiment of FIG. 3 may be a needle valve, as shown in FIG. 1, or alternatively a valve as shown in FIG. 4 may be used. This valve includes a valve body 201 having a first flat seating surface 202. An axial bore 203 extends through the valve body perpendicularly to the surface 202 for rotatably accommodating a shaft 204, which preferably is an extension of the diametral shaft of bufferfly valve 111 of the device of FIG. 3.

A fuel inlet port 205 and a fuel outlet port 206 open into the seating surface 202 in circumferentially spaced relation on a circle concentric with the axis of bore 203. Ports 205 and 206 are adapted to match up with an arcuate groove 207 in a second flat seating surface 208 of a valve plate 209 also having an axial bore 210, when the bore 210 of the valve plate is fitted onto shaft 204 so that the second flat seating surface 208 is in sliding contact with the first flat seating surface 202. Arcuate groove 207 is concentric with bore 210 and has a radius of curvature equal to the radius of the circular locus of fuel ports 205 and 206 in the valve body. The depth of groove 207 progressively increases from one end to the other, so that rotation of valve plate 209 with respect to valve body 201 will progressively vary the cross-sectional area of the portion of the groove connecting inlet port 205 to outlet port 206.

The second sealing surface 208 of valve plate 209 is pressed into sealing engagement with the first sealing surface 202 of the valve body by means of a drive member 211 having a central bore 212 that enables the member to slide onto the end of shaft 204, where it can be fixed by a setscrew 213. Drive member 211 is coupled to valve plate 209 by spring-loaded detent means in the form of compression springs 214 which fit into angularly-spaced blind holes 215 and urge balls 216 into mating sockets 217 formed in the face of valve plate 209 opposite sealing surface 208. The detent means provides a torque transmitting coupling between drive member 211 and valve plate 209, so that rotation of shaft 204 results in rotation of the valve plate, without rigidly fastening the valve plate to the shaft.

The valve of FIG. 4 is inexpensive to manufacture because it is easy to obtain precisely flat sealing surfaces 202 and 208 by well known lapping techniques, while close tolerances are not required for any other dimensions of the valve components, including perpendicularity of the shaft bores to the sealing surfaces. Thus, fluid tight sealing between the valve body and valve plate is possible even for low viscosity liquids such as gasoline in a valve that is inexpensive to make and easy to assemble.

From the foregoing description of the preferred embodiments, it should be apparent that the concept of converting liquid fuel into essentially gaseous form by high speed rotation in an enclosed chamber having a porous peripheral wall and then mixing the gaseous fuel with a stream of air flowing around the chamber results in several important advantages. By processing only liquid fuel, without premixing with air, the size of the fuel chamber can be minimized for a given output of combustible mixture. The high speed rotation of the fuel chamber not only improves the gasification process within the chamber and produces thorough mixing with a stream of air flowing past and around the chamber, but it also prevents any buildup of fuel in the chamber, so that the system has a fast reaction time. This results in good acceleration characteristics while at all times maintaining the proper fuel to air ratio.

Although the invention has been described in connection with its application to internal combustion engines, as a replacement for a conventional venturi-type carburetor, the method of the invention is also applicable for use with other kinds of combustion apparatus, such as furnaces and boilers. Further, it should be noted that reasonably good results can be obtained even without filling the fuel chamber with catalyst impregnated material, but substantial improvement results when a gasification inducing catalyst is used. In this connection, the cupric chloride/nickel chloride combination described above is the preferred catalyst, but other known catalysts may be used, if desired.

I claim:

1. A device for supplying a flow of a gaseous mixture of fuel and air to a combustion apparatus, the device comprising:

a housing having an air intake passage with an inlet end communicating with the atmosphere and an outlet end;

fuel chamber positioned within the intake passage in spaced relation to the passage wall to permit air to flow through the intake passage from the inlet end, around the fuel chamber, to the outlet end, said fuel chamber having an axis of symmetry and a microporous peripheral wall of a rigid material having a pore size of about 4.0 microns, the microporous wall encircling said axis, and said fuel chamber being enclosed so that essentially no air flowing through the intake passage can enter the fuel chamber;

means for supporting the fuel chamber for rotation about its axis of symmetry within the intake passage;

a conduit for delivering liquid fuel to the fuel chamber via said supporting means; and means for rotating the fuel chamber about said axis of rotation to force the fuel centrifugally through said microporous wall, whereby the fuel emerges from the microporous wall in substantially gaseous form and with a velocity component tangential to said porous wall to assure thorough mixing with air flowing through the intake passage around the fuel chamber.

2. The device of claim 1 wherein the fuel chamber contains a carrier material impregnated with a catalyst.

3. The device of claim 2 wherein the carrier material is selected from the group consisting of activated charcoal, alumina, and silica gel.

4. The device of claim 3 wherein the carrier material is granular, with a particle size from about 6 to 16 mesh.

5. The device of claim 1 wherein the microporous peripheral wall of said fuel chamber comprises a porous ceramic material.

6. The device of claim 1 wherein said fuel chamber is disposed coaxially in said intake passage.

7. The device of claim 1 wherein the means for rotating the fuel chamber comprises an electric motor.

8. The device of claim 7 wherein the electric motor is adapted to rotate the fuel chamber at approximately 10,000 rpm.

9. The device of claim 1, further comprising:

a fuel metering valve in said conduit for controlling the flow of liquid fuel therethrough;

a throttle valve positioned in the intake passageway for controlling the flow of gas therethrough; and means coupling the fuel metering valve and the throttle valve for operating said valves together to provide a predetermined relation between fuel flow and gas flow.

10. The device of claim 9 wherein the fuel metering valve comprises a needle valve having a circular seat and a valve shaft mounted for longitudinal movement coaxially with said seat and having a taper at one end engageable with said seat to shut the valve;

the throttle valve comprises a butterfly valve mounted on a diametral shaft between the fuel chamber and the exit end of the intake passageway, the fuel needle valve being mounted so that an extension of the axis of its valve shaft perpendicularly intersects the axis of the diametral shaft of the throttle valve; and the means for coupling the fuel metering valve and the throttle valve comprises a cam plate attached to the other end of the needle valve shaft, the cam plate having a straight elongated slot extending coaxially with the needle valve shaft, said straight slot loosely engaging the diametral shaft of the butterfly valve, and an arcuate slot having a center located on the axis of the straight slot, and an arm fixed to the throttle valve shaft, the arm having a protrusion slidably engaged with the arcuate slot of the cam plate, and the radial distance between the axis of the throttle valve shaft and said protrusion differing by a predetermined amount from the radius of curvature of said arcuate slot, whereby rotation of the throttle valve shaft from shut to open causes translation of the needle valve shaft away from the needle valve seat.

11. The device of claim 1 wherein the exit end of the intake passage is connected to the intake manifold of an internal combustion engine having a starter motor and an ignition coil, and the device further comprises:

a normally closed solenoid valve disposed in the fuel conduit;

a switch connected to the solenoid valve, the switch having a first position connected to the ignition coil and a second position connected to the starter motor, and means responsive to the operating condition of the engine for moving the switch to the first position when the engine is running and to the second position when the engine is not running.

12. The device of claim 1 wherein the fuel chamber comprises:

a frusto-conical cup having a small diameter end and a large diameter end;

a feed tube coaxial with the cup, the feed tube being connected to the conduit for delivering liquid fuel and having an outlet adjacent to the small diameter end of the cup; and a disc-shaped cover closing the large diameter end of the cup, the cover being made of a microporous material, and the microporous peripheral wall of the fuel chamber comprising the circumferential edge of said cover.

13. The device of claim 1 wherein the fuel chamber comprises a cylindrical shell of microporous material and two caps closing the ends of the shell, the axis of rotation of the chamber being the longitudinal axis of said cylindrical shell.

14. A method for providing a gaseous mixture of fuel and air to a combustion apparatus, the method comprising:

delivering a flow of air to a combustion apparatus via an intake passage;

delivering a flow of liquid fuel to a fuel chamber located inside the intake passage, the fuel chamber being completely enclosed such that all of said flow of air passes around the chamber without entering the chamber; and rotating the fuel chamber to urge the fuel by centrifugal force through a peripheral microporous wall of the chamber concentric with the axis of rotation.

15. The method of claim 14 further comprising passing the liquid fuel in the chamber into contact with a carrier material impregnated with a catalyst.

16. The method of claim 14 further comprising varying the flows of fuel and air together to provide a variable flow of the gaseous mixture at a predetermined ratio of fuel to air.

17. A device for supplying a flow of a gaseous mixture of fuel and air to a combustion apparatus, the device comprising:

a housing having an air intake passage with an inlet end communicating with the atmosphere and an outlet end;

an enclosed fuel chamber positioned centrally within the intake passage, said fuel chamber having an axis of symmetry and a microporous peripheral wall encircling said axis, and said fuel chamber containing a carrier material impregnated with a catalyst comprising from 85% to 95% by weight of cupric chloride and from 5% to 15% by weight of nickel chloride;

means for supporting the fuel chamber for rotation about its axis of symmetry within the intake passage;

a conduit for delivering liquid fuel to the fuel chamber via said supporting means; and means for rotating the fuel chamber about said axis to force the fuel centrifugally through said porous wall, whereby the fuel emerges from the porous wall in substantially gaseous form and with a velocity component tangential to said porous wall to assure thorough mixing with air flowing through the intake passage around the fuel chamber.

18. A device for supplying a flow of a gaseous mixture of fuel and air to a combustion apparatus, the device comprising:

a housing having an air intake passage with an inlet end communicating with the atmosphere and an outlet end;

an enclosed fuel chamber positioned centrally within the intake passage, said fuel chamber having an axis of symmetry and a microporous peripheral wall encircling said axis;

means for supporting the fuel chamber for rotation about its axis of symmetry within the intake passage;

a conduit for delivering liquid fuel to the fuel chamber via said supporting means; and means for rotating the fuel chamber about said axis to force the fuel centrifugally through said porous wall, whereby the fuel emerges from the porous wall in substantially gaseous form and with a velocity component tangential to said porous wall to assure thorough mixing with air flowing through the intake passage around the fuel chamber;

a fuel metering valve in said conduit for controlling the flow of liquid fuel therethrough, the fuel metering valve comprising:

a stationary valve body having a first flat seating surface, an axial bore extending perpendicularly to said seating surface, a fuel inlet port, and a fuel outlet port, both ports opening onto said flat surface in circumferentially spaced relation on a circle concentric with said axis;

a valve plate having a second flat seating surface slidably contacting the first seating surface of the valve body, said valve plate having a bore coaxial with the bore of the valve body and an arcuate groove concentric with said bores, the groove having a radius of curvature equal to the distance from said axis to said inlet and outlet ports and subtending an angle greater than that between said inlet and outlet ports, the depth of the arcuate groove progressively increasing from one end thereof to the other end;

a shaft loosely fitting in the bores of the valve body and valve plate;

means for applying a biasing force between the shaft and the valve plate to urge the second flat surface of the valve plate into sealing contact with the first flat surface of the valve body and for rotating the valve plate by rotation of the shaft;

a throttle valve positioned in the intake passageway for controlling the flow of gas therethrough; and means coupling the fuel metering valve and the throttle valve for operating said valves together to provide a predetermined relation between fuel flow and gas flow.

19. The device of claim 18 wherein the throttle valve comprises a butterfly valve mounted on an extension of the shaft of the fuel valve, whereby the means for coupling the fuel metering valve and the throttle valve comprises said shaft.

20. The device of claim 19 wherein the means for applying a biasing force between the shaft and the valve plate and for rotating the valve plate comprises a drive member having a bore therethrough;

means for adjustably fixing the drive member to the shaft of the fuel metering valve on the other side of the valve plate from the valve body; and a plurality of spring-loaded detent means interposed in angularly spaced relation between the drive member and the valve plate.

21. A method for providing a gaseous mixture of fuel and air to a combustion apparatus, the method comprising:

delivering a flow of air to a combustion apparatus via an intake passage;

delivering a flow of liquid fuel to a fuel chamber located inside the intake passage;

passing the liquid fuel in the chamber into contact with a carrier material impregnated with a catalyst comprising a mixture of cupric chloride and nickel chloride; and rotating the fuel chamber to urge the fuel by centrifugal force through a peripheral microporous wall of the chamber concentric with the axis of rotation.

* * * * *